US007059431B2

(12) United States Patent
Simon et al.

(10) Patent No.: US 7,059,431 B2
(45) Date of Patent: Jun. 13, 2006

(54) SELF-PENETRATING DRILLING METHOD AND THRUST-GENERATING TOOL FOR IMPLEMENTING SAME

(75) Inventors: Christophe Simon, Paris (FR); Hedi Sellami, Montrouge (FR)

(73) Assignee: Armines, Paris Cedex (FR)

( * ) Notice: Subject to any disclaimer, the term of this patent is extended or adjusted under 35 U.S.C. 154(b) by 88 days.

(21) Appl. No.: 10/220,385

(22) PCT Filed: Feb. 12, 2001

(86) PCT No.: PCT/FR01/00401

§ 371 (c)(1),
(2), (4) Date: Dec. 16, 2002

(87) PCT Pub. No.: WO01/65052

PCT Pub. Date: Sep. 7, 2001

(65) Prior Publication Data

US 2003/0141109 A1 Jul. 31, 2003

(30) Foreign Application Priority Data

Mar. 1, 2000 (FR) ..... 00 02620

(51) Int. Cl.
*E21B 10/16* (2006.01)

(52) U.S. Cl. ..... 175/377; 175/394

(58) Field of Classification Search ..... 175/40, 175/377, 331, 385, 394, 384
See application file for complete search history.

(56) References Cited

U.S. PATENT DOCUMENTS

| | | | | |
|---|---|---|---|---|
| 2,365,941 A | | 12/1944 | Crake | |
| 3,181,629 A | * | 5/1965 | Birman | 175/40 |
| 4,848,489 A | | 7/1989 | Deane | |
| 5,641,027 A | * | 6/1997 | Foster | 175/107 |
| 5,937,958 A | | 8/1999 | Mensa-Wilmot et al. | |
| 6,167,975 B1 | * | 1/2001 | Estes | 175/331 |

FOREIGN PATENT DOCUMENTS

WO WO99/09290 2/1999

* cited by examiner

*Primary Examiner*—David Bagnell
*Assistant Examiner*—Giovanna Collins
(74) *Attorney, Agent, or Firm*—RatnerPrestia

(57) ABSTRACT

The invention concerns a self-penetrating drilling method and a thrust-generating tool: the tool comprises N blades. Each blade comprised K drill cutters. The shapes, positions and orientations of said drill cutters are determined in the following manner: the $k^{th}$ drill cutter of the last blade drills, at the $(q-1)^{th}$ of the tool rotational cycle, a cut in the rock downstream of the one produced by the $(k+1)^{th}$ drill cutter of the first blade at the $q^{th}$ rotational cycle of the tool; the $k^{th}$ drill cutter of the nth blade drills, at the $q^{th}$ rotational cycle of the tool, a cut in the rock downstream of the one produced by the $k^{th}$ drill cutter of the $(n+1)^{th}$ blade at the $q^{th}$ rotational cycle of the tool; the normal to the leading edge of the drill cutter has a component along the axis of rotation oriented towards upstream.

4 Claims, 8 Drawing Sheets

SELF-PENETRATING DRILLING METHOD AND THRUST-GENERATING TOOL FOR IMPLEMENTING SAME

This invention concerns an auto-penetrating drilling method and a thrust generating tool that makes the application of the method possible.

BACKGROUND OF THE INVENTION

Current directed drilling methods are based on drilling wells presenting a more and more horizontal departure. Because of friction between the drilling assembly and the borehole in slanted and horizontal areas, the horizontal departure is limited since it is not possible to transmit sufficient weight behind the tool.

A solid monoblock drilling tool is composed of two main parts: an internal part called "tool nose" whose drill cutters dig into the bottom of the drill hole, and an external part called "tool flank" whose drill cutters mainly dig into the walls of the drill hole. In particular, this invention deals with the cutting method of the cutting sub-structure that constitutes the tool flank. This invention also concerns the cutting sub-structure that makes the method application possible.

SUMMARY OF THE INVENTION

Method

Using a drilling tool that rotates around an axis, the method described in this invention consists of the generating of a thrust parallel to the direction of the said axis and oriented in the heading direction of the said tool in the rock.

Therefore it is possible to reduce or eliminate (auto-penetration) the need for weight behind the tool, and thus, also to increase the horizontal drilling extension potential.

In one application, the method is such that the thrust on said drilling tool is the result of the reaction of the rock on the drilling tool during the mechanical cutting action of the rock by the drilling tool.

Preferably, the tool consists of N blades, numbered from 1 to N in the inverse direction to that of the rotation action. Each blade is arranged in a spiral around the tool axis, and is positioned on a slanted angle compared to the tool axis. The blade part closest to the tool nose is also the closest to the tool axis. Each blade is composed of K drill cutters. The first drill cutter is that closest to the tool axis and tool nose. Each drill cutter is identified with two reference indexes:

the first index n, variant from 1 to N corresponds to the number of the blade on which the drill cutter in question is mounted, the second index k, variant from 1 to k, corresponds to the position of the drill cutter in question on the blade, beginning from the first drill cutter.

Therefore, the k-th drill cutter of the n-th blade will be defined as drill cutter T(n,k).

Each drill cutter has a face, hereafter referred to as driving face that makes the contact with the rock.

Preferably in this invention, in order to generate a thrust in the tool heading direction, the geometries, positions, and orientations of all or part of said drill cutters are calculated respecting the following rules:

the k-th drill cutter of the last blade T(N,k) cuts a groove in the rock to the previous rotation R(q−1) of the tool downstream of the groove cut by the (k+1)th drill cutter on the first blade, T(1,k+1) at the current rotation Rq of the tool.

The k-th drill cutter of the n-th blade, T(n,k) cuts a groove into the rock to the current rotation Rq of the tool downstream of the groove cut by the k-th drill cutter of the (n+1)th blade, T(n+1,k), at the current rotation Rq of the tool.

The normal, or perpendicular to the drill cutter driving face has a component according to the rotation axis in the upstream direction.

Tool

The invention also consists of an auto-penetrating drilling tool designed for well drilling in rock. The drilling tool that functions in rotation around an axis, includes a sub-structure that forms the flank of the tool and that generates a thrust parallel to the direction of said axis and oriented in the heading direction of said tool in the rock.

According to one application method, the drilling tool is such that this thrust on said drilling tool is the result of the reaction of the rock on the drilling tool during the mechanical cutting action of the rock by the tool.

Preferably, the tool is composed of N blades numbered from 1 to N in the inverse direction to that of the rotation action. Each blade is arranged in a spiral around the tool axis, and is positioned on a slanted angle compared to the tool axis. The blade part closest to the tool nose is also the closest to the tool axis. Each blade is composed of K drill cutters. The first drill cutter is the cutter closest to the tool axis and tool nose. Each drill cutter is identified with two reference indexes:

the first index n, variant from 1 to N corresponds to the number of the blade on which the drill cutter in question is mounted, the second index k, variant from 1 to k, corresponds to the position of the drill cutter in question on the blade, beginning from the first drill cutter.

In this manner, the k-th drill cutter of the n-th blade will be defined as drill cutter T(n,k).

Each drill cutter has a face, hereafter referred to as driving face that makes the contact with the rock.

The geometries, positions, and orientations of all or part of said drill cutters are such that:

the k-th drill cutter of the last blade T(N,k) cuts a groove in the rock to the previous rotation R(q−1) of the tool downstream of the groove cut by the (k+1)th drill cutter on the first blade, T(1,k+1) at the current rotation Rq of the tool.

The k-th drill cutter of the n-th blade, T(n,k) cuts a groove into the rock to the current rotation Rq of the tool downstream of the groove cut by the k-th drill cutter of the (n+1)th blade, T(n+1,k), at the current rotation Rq of the tool.

The normal, or perpendicular to the drill cutter driving face has a component according to the rotation axis in the upstream direction.

BRIEF DESCRIPTION OF THE DRAWINGS

Other characteristics and advantages of this invention will be explained during the description of the variants of the invention application, given here as an example that is indicative but not limitative, and with the.

DETAILED DESCRIPTION

Below is a description of the variants of the implementation of the drilling tool according to this invention and shown in the diagrams.

Figure 1:
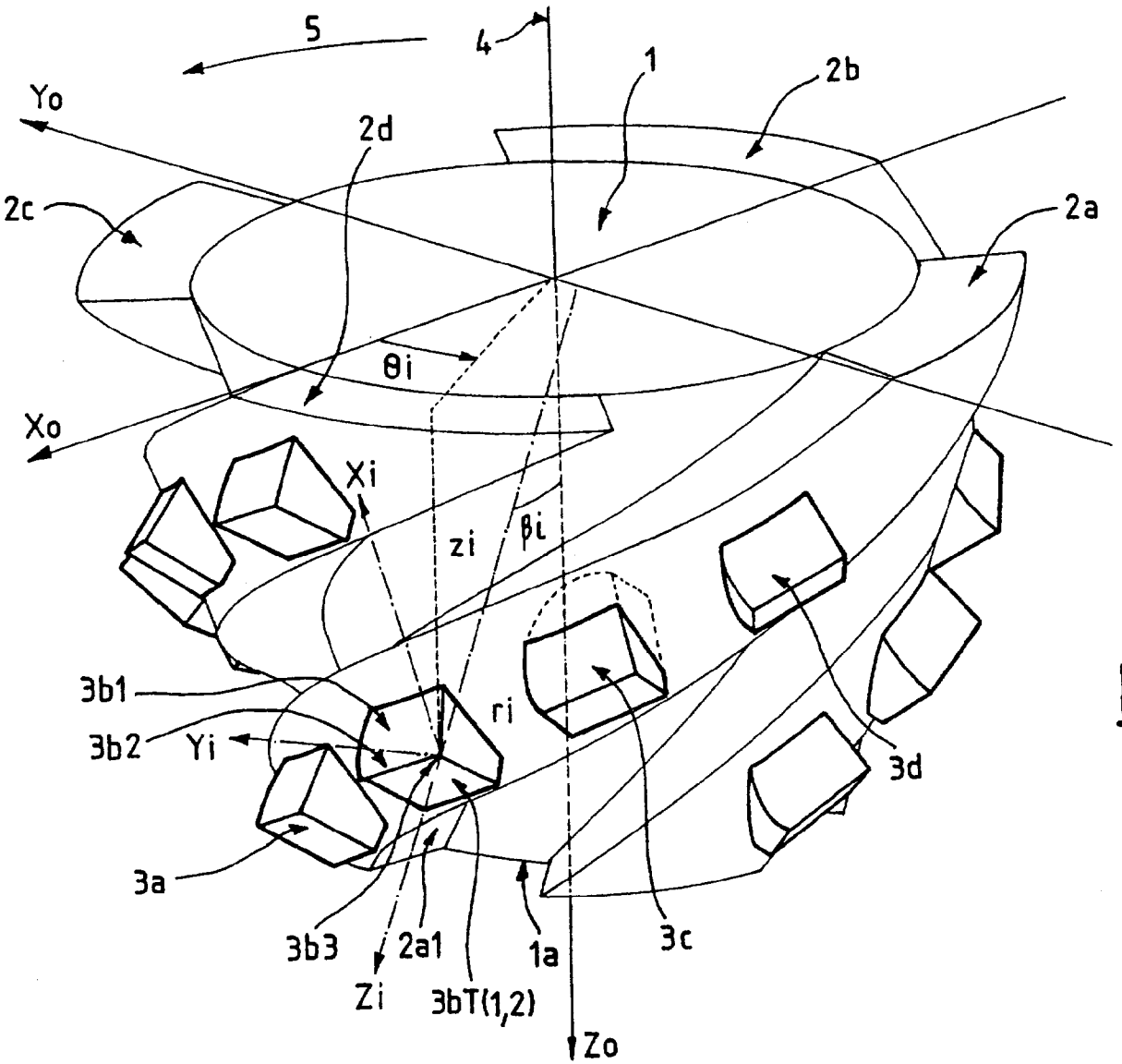
FIG. 1 that represents a view in perspective of a drilling tool as described in this invention, consisting of four blades and four drill cutters per blade. This diagram also shows the local reference marks (Xi, Yi, Zi) and the total reference marks (Xo, Yo, Zo) that are used to define the position of the drill cutters, FIG. 2 that shows a view of a drilling tool from below, FIG. 3 that shows the geometry of a drill cutter, FIG. 4 that shows the position and the orientation of a drill cutter according to a local reference point (Xi, Yi, Zi), FIG. 5 that shows a view in perspective of the interactions between the drill cutters and the rock, FIG. 6 that shows, in the case of a tool composed of four blades and two drill cutters, the position and the order of the passage of the drill cutters on a fixed plane of space, passing through the rotation axis of the tool, FIG. 7 that shows graphically, in the case of a tool composed of four blades and two drill cutters, the evolute of the cut structure according to the penetration axis and the order of the drill cutter passage, and FIG. 8 that shows a schematic view in perspective of the elementary interaction between a drill cutter and the rock.

FIG. 1 shows a view in perspective of a drilling tool 1 as described in this invention, composed of four blades 2*a*, 2*b*, 2*c*, 2*d* and four drill cutters 3*a*, 3*b*, 3*c*, 3*d* per blade. This figure also shows a local reference mark (Xi, Yi, Zi) and the total reference mark (Xo, Yo, Zo) used to define the position (ri, zi, Oi) of the drill cutters. The tool functions in rotation around an axis 4 (axis Zo). The four blades (2*a*, 2*b*, 2*c*, 2*d*) are numbered 1 to 4 in the inverse direction 5 of the rotation. Conventionally, the first blade is that which is mounted with the drill cutter closest to the tool axis; it is numbered (1) and corresponds to blade 2*a* in FIG. 1. Blades 2*b*, 2*c*, 2*d* are numbered respectively 2, 3, 4. Each blade 2*a*, 2*b*, 2*c*, 2*d* is arranged in a spiral rising around axis 4 of tool 1, and is positioned on a slant compared to the axis. The part, 2*a*1 of blade 2*a* closest to the tool nose 1 is also closest to axis 4 of the tool.

Each blade is mounted with four drill cutters. In this manner blade 2*a* is mounted with drill cutters 3*a*, 3*b*, 3*c*, 3*d*. Conventionally, the first drill cutter of each blade is the closest to axis 4 and the tool nose 1. Therefore the first drill cutter on blade 2*a* is drill cutter 3*a*. Respectively, drill cutters 3*b*, 3*c*, 3*d* are the second, third and fourth drill cutters mounted on blade 2*a*. Each drill cutter is identified by two reference indexes:

the first index n, variant from 1 to 4 corresponds to the number of the blade mounted with the drill cutter in question, the second index k, variant from 1 to 4, corresponds to the position of the drill cutter in question on the blade, beginning from the first cutter, This way the k-th drill cutter of the n-th blade will be defined as T(n,k). For example, the second drill cutter 3*b* on the first blade 2*a* is defined as drill cutter T (1,2).

Each drill cutter has:

one face, hereafter referred to as driving face, that is in contact with the rock, a cutting edge a point of contact.

In the case of drill cutter 3*b*, T(1,2), the driving face bears the reference 3*b*1, the cutting edge bears the reference 3*b*2, and the point of contact bears reference 3*b*3. Using drill cutter 3*b* T(1,2) as a reference example, below is the explanation on how the local reference mark (Xi, Yi, Zi) is constructed, in order to define the position of drill cutter 3*b* T(1,2). Axis Zi is situated in the meridian plane passing through axis 4 and the point of contact 3*b*3. Axis Zi is on an angle βi compared to axis 4. Axis Xi is brought by the perpendicular to axis Zi situated in the meridian plane, passing through the point of contact 3*b*3. Axis Yi, perpendicular to axis Zi and axis Xi at point of contact 3*b*3, completes the ortho-normal reference point, since its origin is the point of contact 3*b*3. The co-ordinates of the origin of the ortho-normal reference points Xi, Yi, Zi, in the references XO, Yo, Zo, are Zi, ri, θi.

Figure 2:
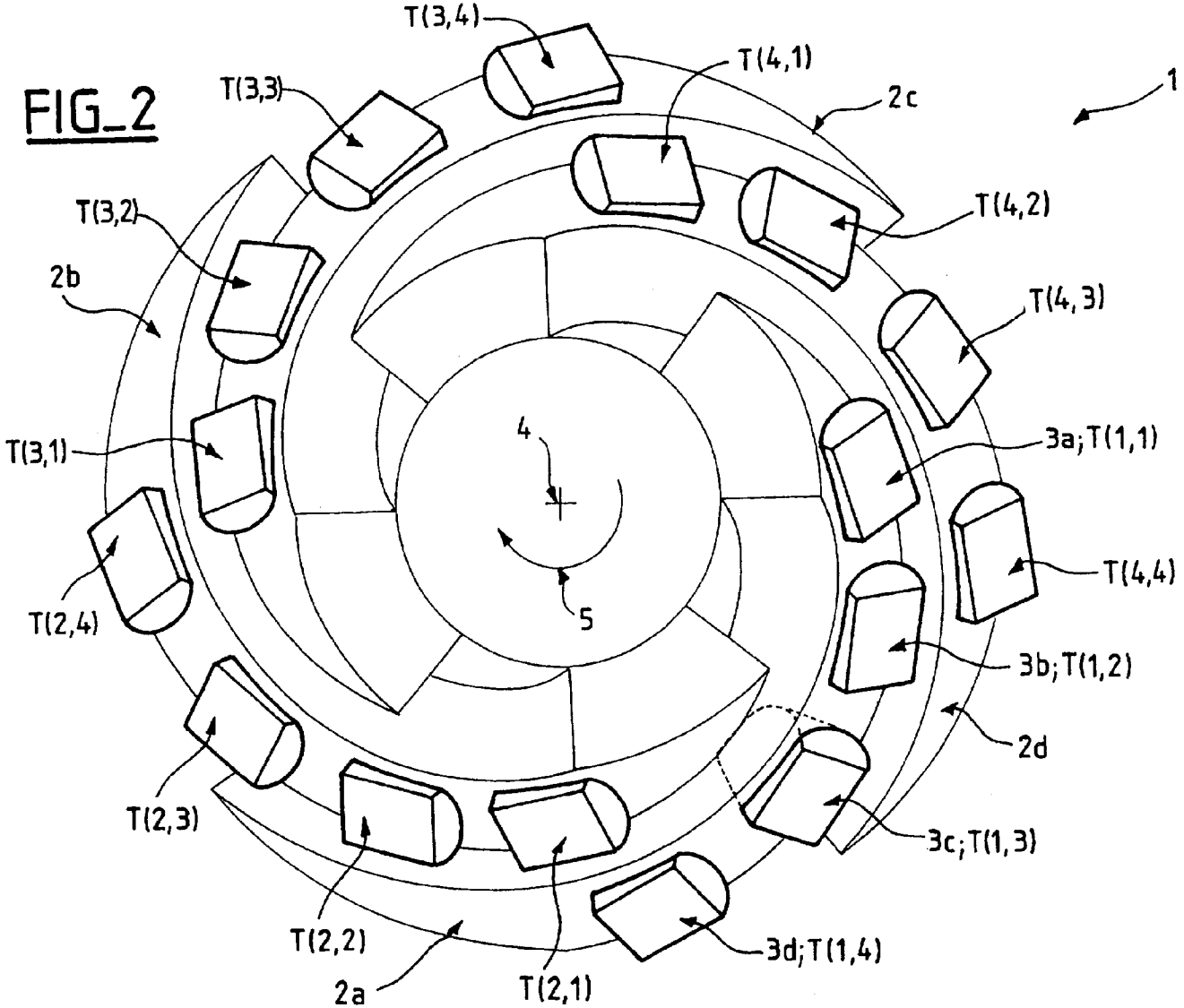

FIG. 2 shows the view of the drilling tool 1 from below and most of the elements that have been described can be recognised by referring to FIG. 1. Both figures show the same reference marking.

Figure 3:
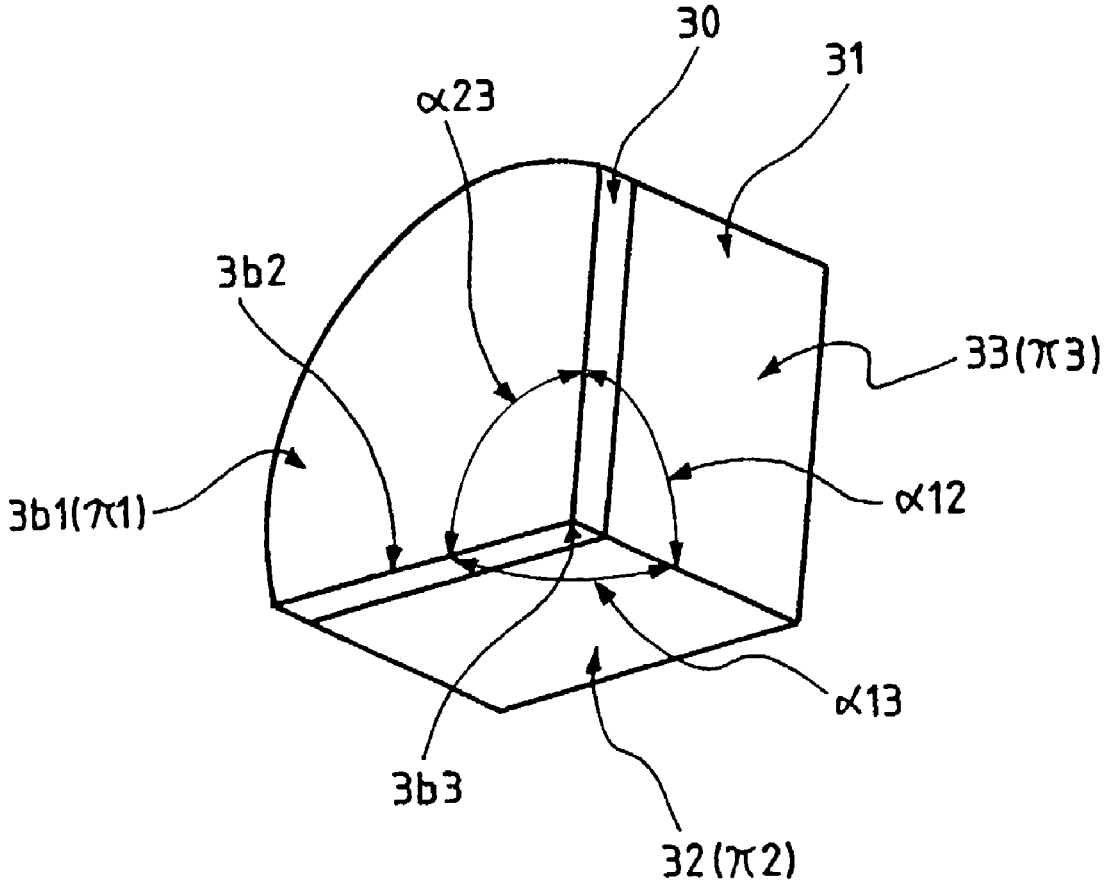

Using FIG. 3 as reference, below is the description of the structure and the geometry of an elementary drill cutter (for example, drill cutter 3*b*). The bort 30, is presented in the form of a small plate in the shape of a quarter circle.

Figure 5:
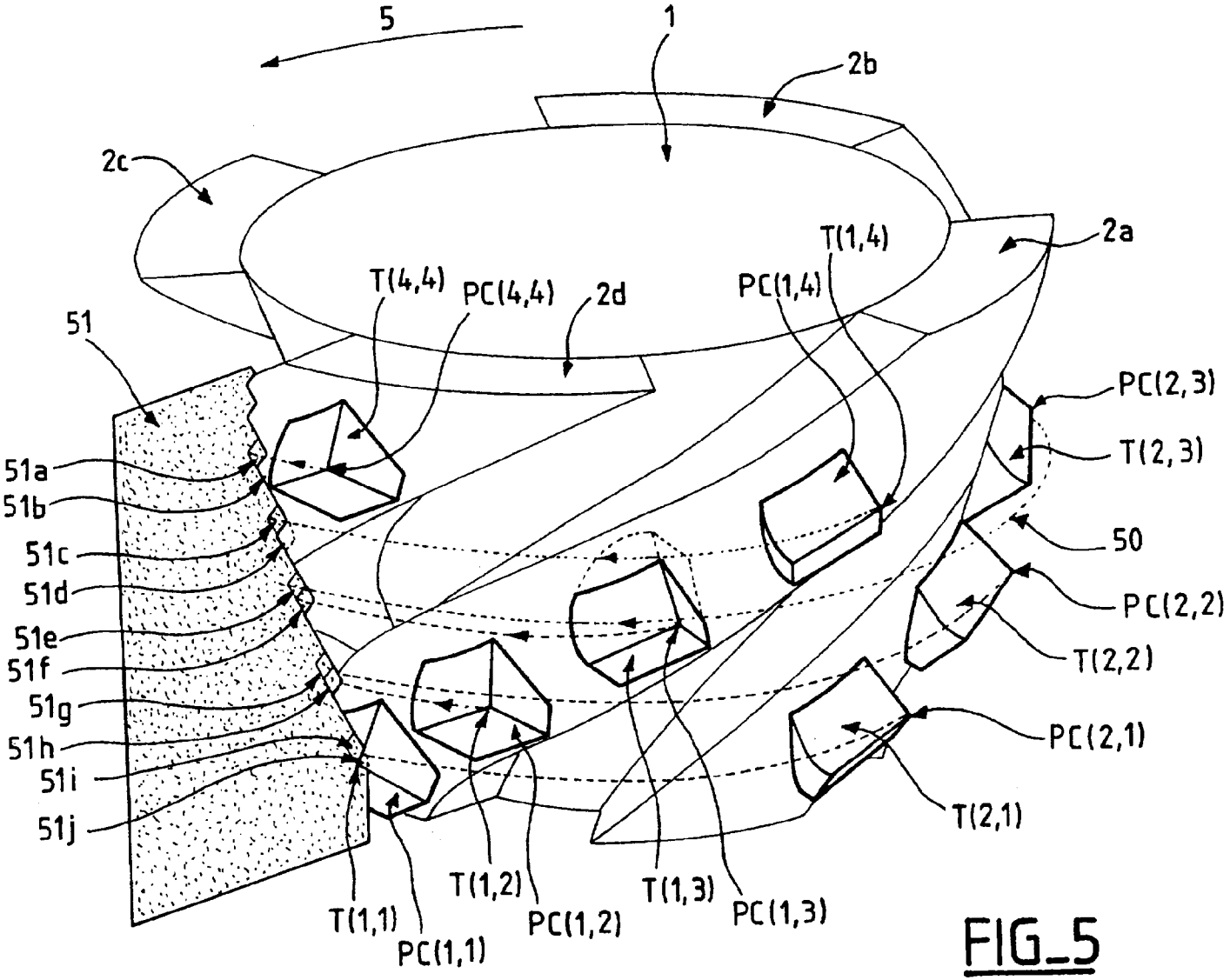

The quarter circle shape is not visible in FIGS. 1, 2, and 5, because part of the drill cutter is set inside the blade for fixation. The hidden part of drill cutter 3*c* is shown with dotted lines in FIGS. 1, 2, and 5.

Figure 4:
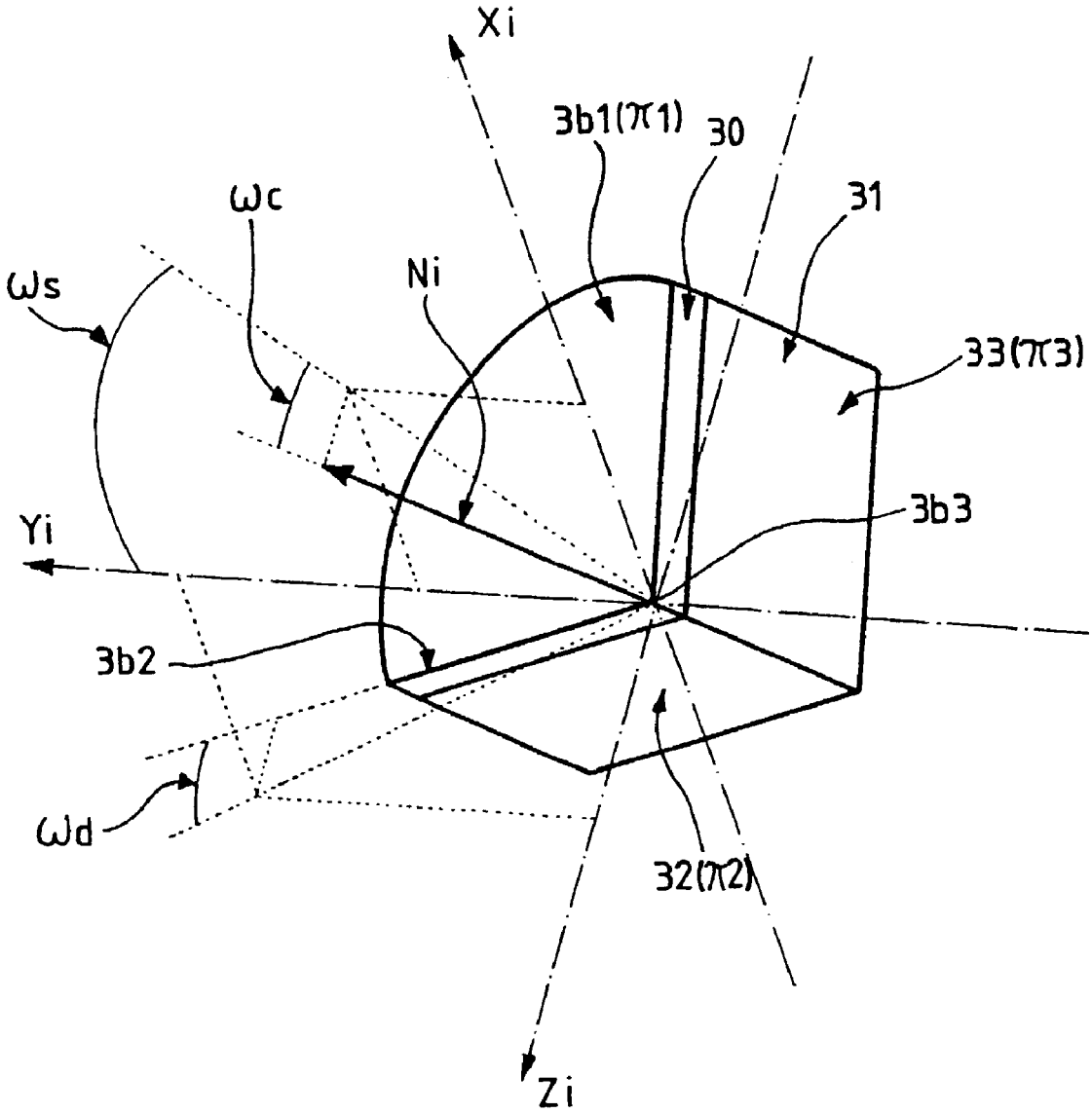

The bort 30, is incorporated into a structure 31, made of tungsten carbide, using a familiar method (soldering). FIG. 4 shows the driving face π1, reference 3*b*1, the cutting edge, reference 3*b*2, the point of contact with the rock, reference 3*b*3. FIG. 4 also shows the position relative to the tool flank π2, reference 32, and the lateral backing π3, compared to the driving face 3*b*1. The tool flank π2, 32, is visibly perpendicular to the driving face 3*b*1 as visibly parallel to plane (Xi, Yi). The lateral tool flank π3,33, is visibly perpendicular to the driving face 3*b*1 as well as plane (Xi, Yi). The notations α13, α12, α23, describe the dihedral angles respectively (π1,π3), (π1,π2), and (π2,π3). Further on it will be shown how these angles preferably have particular values between 80° and 120°.

Below is a description of FIG. 4 that shows the position and the orientation of a drill cutter in a local reference (Xi, Yi, Zi).

From hereon in the description, the following will be called:

cutting edge ωc, the slanting angle of the normal perpendicular Ni to the driving face 3*b*1 compared to plane Xi, Yi, lateral angle ωs, the angle of axis Yi with the projection of the normal perpendicular Ni to the driving face 3*b*1 on plane Xi, Yi.

exit angle ωd, the angle of inclination of the cutting edge 3*b*2 compared to plane Xi, Yi.

It will be demonstrated further on that these angles preferably have special values as follows: the cutting angle ωc ranges between 0° and 40°, the lateral angle ωs, ranges between 30° and 80°, and the exit angle cod, ranges between 0° and 10°.

In order to generate thrust in the driving direction of the tool, the geometries, positions and orientations of all or part of said drill cutters are calculated respecting the following rules:

the k-th drill cutter of the last blade T(N,k) cuts a groove in the rock to the previous rotation R(q−1) of the tool downstream of the groove cut by the (k+1)th drill cutter on the first blade, T(1,k+1) at the current rotation Rq of the tool.

the k-th drill cutter of the n-th blade, T(n,k) cuts a groove into the rock to the current rotation Rq of the tool downstream of the groove cut by the k-th drill cutter of the (n+1)th blade, T(n+1,k), at the current rotation Rq of the tool.

the normal, or perpendicular to the drill cutter driving face has a component according to the rotation axis in the upstream direction.

Below is the explanation of the rules with reference to FIGS. 5, 6, 7, and 8. FIG. 5 shows the view in perspective, of the interactions between the drill cutters and the rock 51, the elements described with reference to FIG. 1. They have the same numerical reference marks. From hereon in the description PC (n, k) will define the point of contact of the drill cutter (T(n, k). The oriented trajectories of certain points of contact have been marked using dotted lines with arrows (50).

It can be seen that the point of contact PC (4,4) of the drill cutter (T (4,4) cuts a groove 51*a* into the rock 51 upstream of the groove 51*b* previously cut by another drill cutter.

In the same way, it can be seen that the point of contact PC (1,4) of the drill cutter T (1,4) cuts a groove 51*c* into the rock 51 upstream of the groove 51*d* previously cut by another drill cutter.

In the same way, it can be seen that the point of contact PC (2,3) of the drill cutter T (2,3) cuts a groove 51*e* into the rock 51 upstream of the groove 51*f* that will be previously cut by the point of contact PC(1,3) of drill cutter T(1,3).

In the same way, it can be seen that the point of contact PC (2,1) of the drill cutter T (2,1) cuts a groove 51*i* upstream of the groove 51*j* that will be previously cut by the point of contact PC(1,1) of drill cutter T(1,1).

In the same way, it can be seen that the point of contact PC (2,2) of the drill cutter T (2,2) cuts a groove 51*g* upstream of the groove 51*h* that will be previously cut by the point of contact PC(1,2) of drill cutter T(1,2).

Figure 6:
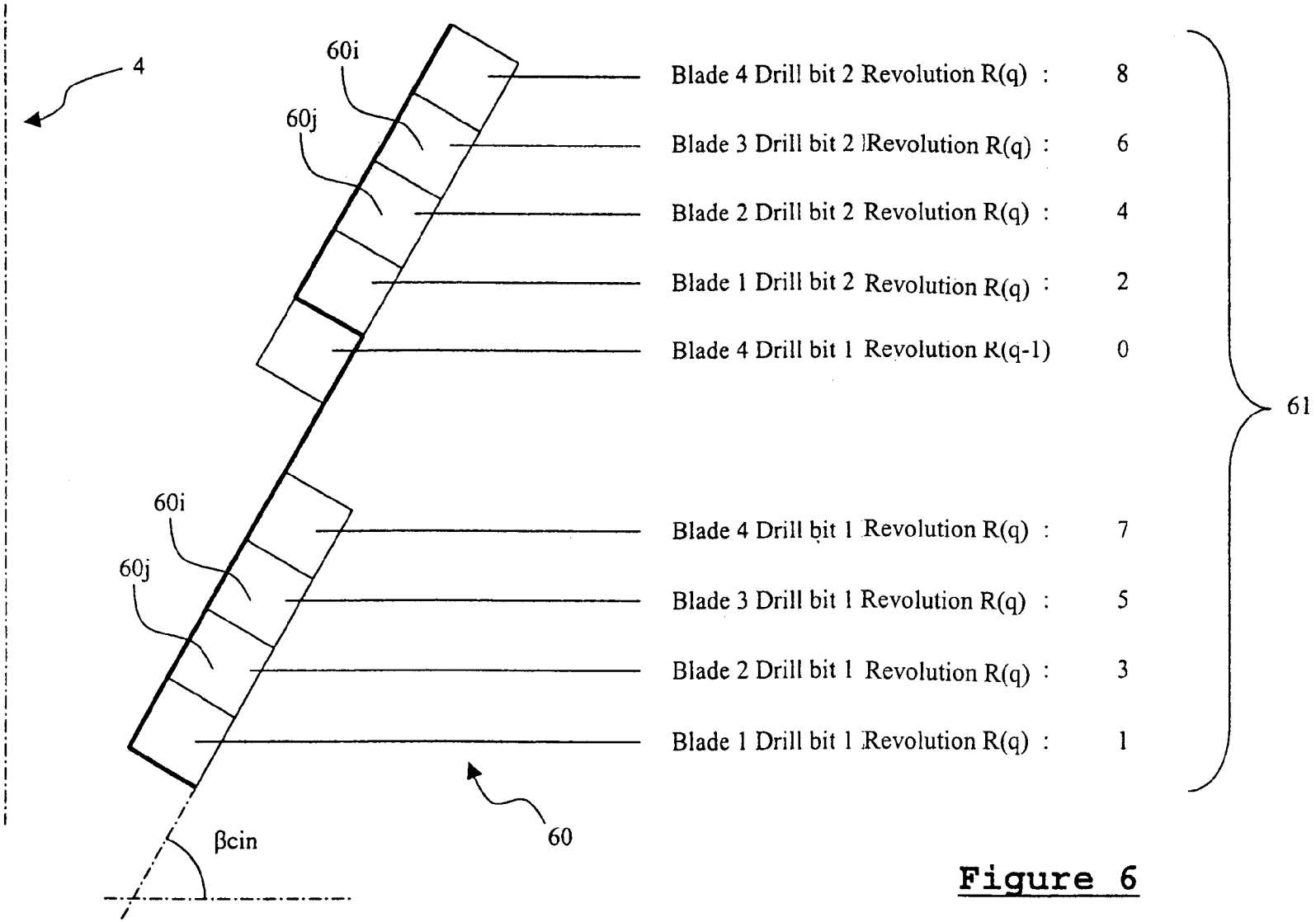

The diagram in FIG. 6 shows, in the case of a tool with four blades mounted with two drill cutters, the position and the passage order 61 of the drill cutters in a fixed plane that pass through the tool axis. It can be seen that as the tool rotates, the grooves 61*i* are cut into the rock 60 by the drill cutters, upstream of a groove 60*j*, previously cut by another drill cutter.

Figure 7:
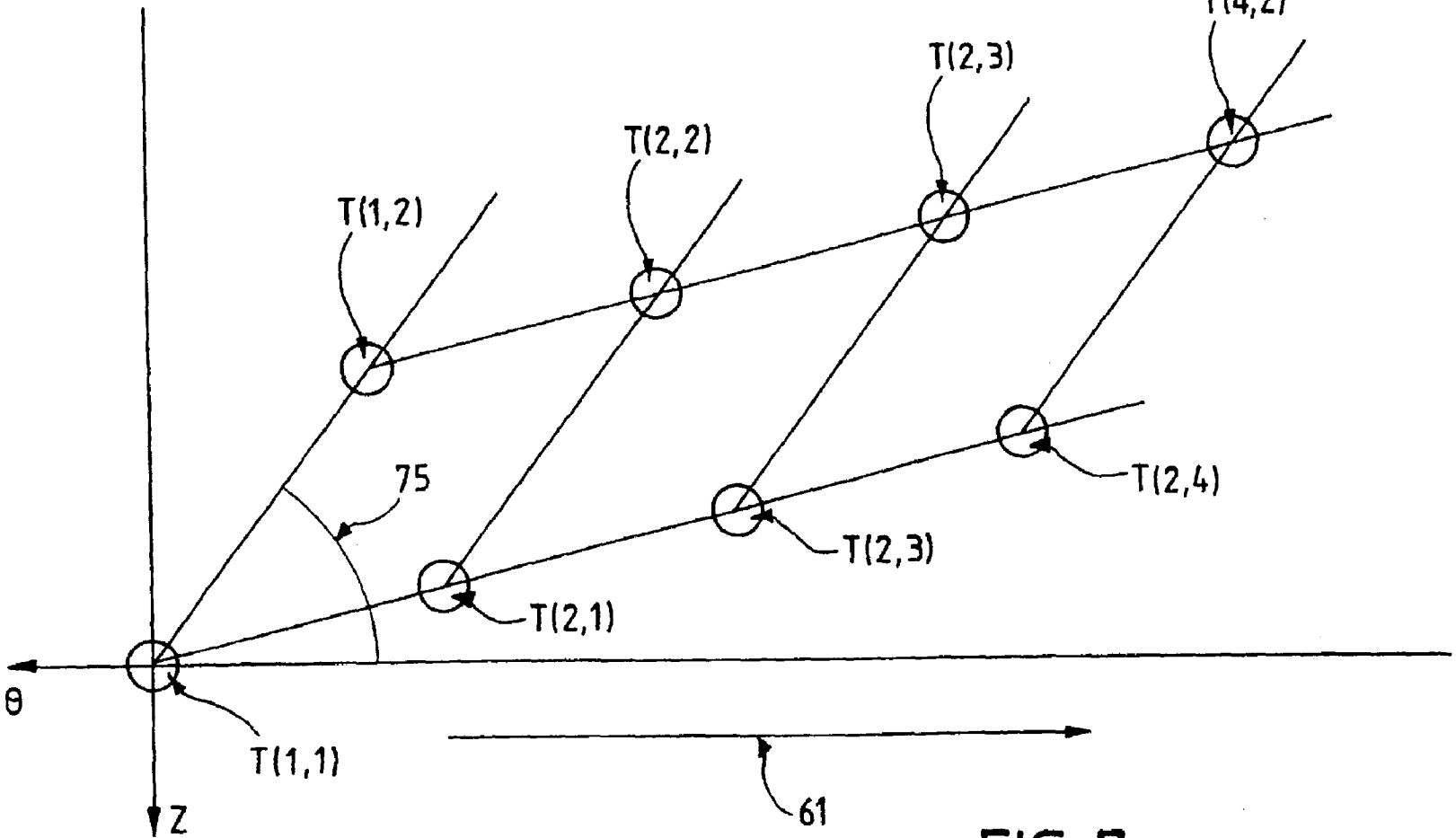

FIG. 7 shows graphically, in the case of a tool with four blades mounted with two drill cutters, the evolute of the cutting structure according to the penetration axis (axis 2) and the passage order 61 of the drill cutters.

Figure 8:
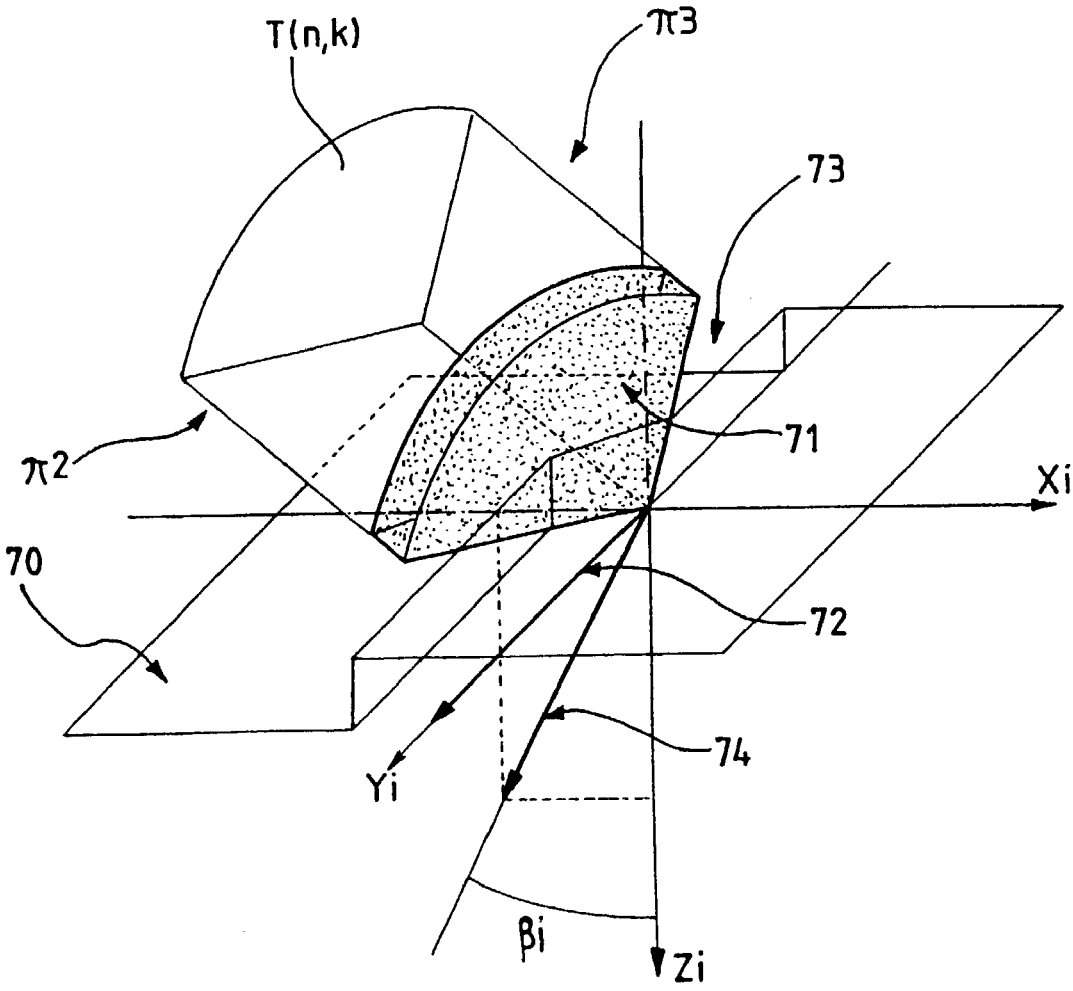

FIG. 8 shows a schematic view in perspective of the elementary interaction between a drill cutter T(n,k) and the rock 70. The driving face 71, is in contact with the rock in the clearance direction 72 of the drill cutter, and cuts a groove 73. The drilling tool moves from upstream towards downstream in the direction shown by the arrow 74. The reaction force of the rock on the drill cutter exercise the thrust directed in the direction of the arrow 74.

Below is a description of the main calculation stages used to determine the geometries, positions, and orientations of said drill cutters aimed at obtaining the cutting methods that have been described immediately above, and the generation of the thrust oriented in the driving direction of the drilling tool in the rock;

first, the drive step is chosen according to tool revolution δcin.

then the lateral inclination slant βcin is chosen for the cutting plane according to drive step δin. It must be noted that when the tool drills following its axis according to the drive step per revolution δcin, the grooves cut by the k-th drill cutters of each blade during the same revolution are aligned according to a straight line slanted at an angle of δcin compared to the horizontal plane, as shown in FIG. 6.

the height h, and the width d, of the rectangular section of the elementary groove made by the drill cutters are then chosen.

following this, the cut angle ωc, the lateral angle ωs, and the exit angle ωd, are chosen.

Now the lateral inclination slant βi of the drill cutters are chosen in order to ensure that the tool flank π2 is not too close behind. The lateral inclination slant βi is the inclination of axis Zi of the i-th drill cutter reference mark compared to the Zo axis as shown on FIG. 1.

The driving step δhel is chosen following Zo of the tool blades. The total of the drill cutter points of contact of the same blade compose a helix wound around the axis z in the inverse direction to the rotation direction, whose step, marked as δhel, and constant for all blades, corresponds to the blade driving step. This driving step 75 is illustrated in FIG. 7.

Now the position (r11, z11, θ11) of the first drill cutter on the first blade, is chosen.

At this point the position relative to the k-th drill cutters on two consecutive blades is calculated.

Then a calculation is made of the position relative to the two consecutive drill cutters on a same blade.

Preferably, the limits are fixed according to the following parameters:

the cutting angle ωc is lower than or equal to 30°.

the lateral angle ωs is higher than or equal to 60°.

the lateral inclination slant βcin of the cutting plane is higher than or equal to 50°.

the lateral inclination slant of the drill cutters βi is higher than or equal to the lateral inclination slant βcin of the cutting plane.

the height h, of the rectangular section of the groove is lower than or equal to 1 mm.

the width d, of the rectangular section of the groove is lower than or equal to twice the height h of the rectangular section of the groove.

With these explanations in hand, those skilled in the art are capable of determining the geometries, positions and orientations of said drill cutters by consecutive iterations, in order to generate the thrust oriented in the driving direction of the drilling tool in the rock.

The invention claimed is:

1. Auto-penetrating drilling method for well drilling in rock; using a drilling tool rotating around an axis, said method comprises generating, by the rotation of the drilling tool, of a thrust parallel to the direction of said axis and oriented in a heading direction of the tool in the rock, wherein:

the thrust on the drilling tool is generated by the reaction of the rock on the drilling tool during the mechanical cutting of the rock by the drilling tool and;

said tool is composed of N blades numbered from 1 to N in the opposite direction to a rotation direction; each blade being arranged in a spiral around the axis of the tool and on a slant with the tool axis; the part of the blade closest to the tool nose is also the closest to the tool nose axis;

each blade is mounted with k drill cutters; the first drill cutter is the cutter closest to the axis and the tool nose; each drill cutter is identified with two index references;

the first index reference n, variant between 1 and N, corresponds to the number of the blade on which the drill cutter in question is mounted, the second index reference k, variant between 1 and K, corresponds to a position of the drill cutter in question on the blade starting from the first drill cutter, in this way the k-th drill cutter of the n-th blade is identified as drill cutter T(n,k);

each drill cutter has a face, hereafter referred to as driving face that makes contact with the rock;

this method is such that, to generate a thrust in the heading direction of the tool, the geometries, positions, and orientations of all or part of the said drill cutters are calculated respecting the following rules;

the k-th drill cutter of the last blade T(N,k) cuts a groove in the rock at a previous revolution R(g−1) of the tool downstream of the groove cut by the (k+1)th drill cutter on the first blade, T(1,k+1) at a current rotation R(g) of the tool;

the k-th drill cutter of the n-th blade, T(n,k) cuts a groove into the rock at a current revolution R(g−1) of the tool downstream of the groove cut by the k-th drill cutter of the (n+1)th blade, T(n+1,k), at the current rotation R(g) of the tool;

a perpendicular to the drill cutter driving face has a component according to the rotation axis in the upstream direction.

2. Apparatus comprising an auto-penetrating drilling tool for well drilling in rock; said auto-penetrating drilling tool rotating around an axis, said auto-penetrating drilling tool being configured such that the rotation of said drilling tool generates a thrust parallel to the direction of said axis, and oriented in a heading direction of said tool in the rock, wherein:

the drilling tool is further configured such that the thrust on the drilling tool is generated by the reaction of the rock on the drilling tool during the mechanical cutting of the rock by the drilling tool; and said tool is composed of N blades numbered from 1 to N in the opposite direction to the rotation direction; each blade is arranged in a spiral around the tool axis and set a slant compared to the axis; a part of the blade closest to a nose section of the tool is also the closest to the tool axis;

each blade is mounted with k drill cutters; the first drill cutter is the cutter closest to the axis and the tool nose; each drill cutter is identified with two index references;

the first index reference n, variant between 1 and N, corresponds to a number of the blade on which the drill cutter is mounted, the second index reference k, variant between 1 and K, corresponds to a position of the drill cutter on the blade starting from the first drill cutter, whereby the k-th drill cutter of the n-th blade is identified as drill cutter T(n,k);

each drill cutter has a driving face that makes contact with the rock;

geometries, positions and orientations of all or part of the said drill cutters are determined by respecting the following rules;

the k-th drill cutter of the last blade, T(N,k) cuts a groove into the rock at a previous revolution R(g−1) of the tool downstream of the groove cut by the (k+1)th drill cutter of the first blade, T(1,k+1), at a current rotation R(g) of the tool;

the k-th drill cutter of the n-th blade, T(n,k) cuts a groove into the rock at a current revolution R(g) of the tool downstream of the groove cut by the k-th drill cutter of the (n+1)th blade, T(n+1,k), at the current rotation R(g) of the tool;

a perpendicular to the drill cutter driving face has according to the rotation axis in the upstream direction.

3. The method according to claim 1, wherein blades and drill cutters are geometrically arranged on said drilling tool in order to generate said thrust by reaction of the rock on the drilling tool during its rotation.

4. Drilling tool according to claim 2, wherein blades and drill cutters are geometrically arranged on said drilling tool in order to generate said thrust by reaction of the rock on the drilling tool during its rotation.

* * * * *